US012076627B2

(12) United States Patent
Harrer

(10) Patent No.: US 12,076,627 B2
(45) Date of Patent: Sep. 3, 2024

(54) RACKET DAMPENER SWING SENSOR APPARATUS

(71) Applicant: Rudolf Harrer, New York, NY (US)

(72) Inventor: Rudolf Harrer, New York, NY (US)

( * ) Notice: Subject to any disclaimer, the term of this patent is extended or adjusted under 35 U.S.C. 154(b) by 314 days.

(21) Appl. No.: 17/464,359

(22) Filed: Sep. 1, 2021

(65) Prior Publication Data

US 2023/0069340 A1 Mar. 2, 2023

(51) Int. Cl.

| | |
|---|---|
| ***A63B 60/46*** | (2015.01) |
| ***A63B 24/00*** | (2006.01) |
| ***A63B 60/54*** | (2015.01) |
| *A63B 102/02* | (2015.01) |

(52) U.S. Cl.

CPC ..... *A63B 60/46* (2015.10); *A63B 24/0003* (2013.01); *A63B 60/54* (2015.10); *A63B 2102/02* (2015.10); *A63B 2220/44* (2013.01); *A63B 2220/801* (2013.01); *A63B 2220/833* (2013.01); *A63B 2225/50* (2013.01)

(58) Field of Classification Search

CPC ..... A63B 60/46; A63B 24/0003; A63B 60/54; A63B 2102/02; A63B 2220/833; A63B 49/00

See application file for complete search history.

(56) References Cited

U.S. PATENT DOCUMENTS

| | | | | |
|---|---|---|---|---|
| 4,761,007 | A * | 8/1988 | Boschian | A63B 60/54 473/522 |
| 4,927,143 | A * | 5/1990 | Hillock | A63B 60/54 473/522 |
| 6,134,965 | A * | 10/2000 | Somville | A63B 49/00 73/488 |
| 6,755,756 | B2 * | 6/2004 | Sung | A63B 51/02 473/522 |
| D562,922 | S | 2/2008 | Bozof | |
| 7,335,118 | B1 * | 2/2008 | Sung | A63B 69/38 473/553 |
| 7,427,245 | B2 | 9/2008 | Hickey | |
| 7,517,293 | B1 * | 4/2009 | Smith | A63B 71/0672 273/DIG. 26 |
| 7,530,910 | B1 | 5/2009 | Niksich | |
| 10,668,355 | B2 * | 6/2020 | Knab | A63B 69/3635 |

(Continued)

FOREIGN PATENT DOCUMENTS

| | | |
|---|---|---|
| WO | WO9717590 | 5/1997 |

*Primary Examiner* — Seng H Lim

(57) ABSTRACT

A racket dampener swing sensor apparatus to obtain measurements of parameters relative to the player's performance while reducing vibration includes a dampener body having a body front side, a body back side, and a body perimeter. The body perimeter has a string channel to selectively engage a plurality of strings of a tennis racket. The dampener body absorbs vibration from the plurality of strings. An accelerometer and a microcontroller with memory are coupled within the dampener body to measure hit velocity for each shot type (forehand, backhand, serve, topspin, slice, or flat). A vibration sensor is provided to detect when a ball is struck. A transceiver is coupled within the dampener body to wirelessly communicate with an app on a smartphone or computer. A battery is coupled within the dampener body and a charge port is in operational communication with the battery.

7 Claims, 5 Drawing Sheets

(56) References Cited

U.S. PATENT DOCUMENTS

| | | | | |
|---|---|---|---|---|
| 2007/0265120 | A1* | 11/2007 | Hickey | A63B 60/54 377/5 |
| 2013/0217520 | A1* | 8/2013 | Gaede | A63B 69/38 473/422 |
| 2015/0057112 | A1* | 2/2015 | Sak | A63B 49/00 473/461 |
| 2015/0141175 | A1* | 5/2015 | Pisupati | G09B 19/0038 473/461 |
| 2015/0157901 | A1 | 6/2015 | Mace | |
| 2016/0074739 | A1* | 3/2016 | Pisupati | G06Q 10/0639 700/92 |
| 2019/0126126 | A1* | 5/2019 | Knab | A63B 69/3635 |

* cited by examiner

RACKET DAMPENER SWING SENSOR APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to racket dampener devices and more particularly pertains to a new racket dampener device to obtain measurements of parameters relative to the player's performance while reducing vibration. The present invention includes both a multi-axis accelerometer to detect velocity as well as a gyroscope sensor to identify the parameter (forehand, backhand, serve, topspin, or flat) determined by linear acceleration and angular speeds of the dampener. The device may also include a Bluetooth transmitter to interact with an app to record these metrics, as well as a microcontroller to retrieve and process data from the accelerometer and gyroscope. The device may also include flash storage for onboard memory to store the data.

(2) Description of Related Art Including Information Disclosed Under 37 CFR 1.97 and 1.98

The prior art relates to racket dampener devices. Known devices typically serve to either dampen vibration or to serve as sensors. These devices lack both an accelerometer and a gyroscope, as well as the onboard memory and microcontroller to retrieve and process data. Known devices also lack a transceiver to wirelessly interact with an app to analyze the data collected.

BRIEF SUMMARY OF THE INVENTION

An embodiment of the disclosure meets the needs presented above by generally comprising a dampener body having a body front side, a body back side, and a body perimeter. The body perimeter has a string channel configured to selectively engage a plurality of strings of a tennis racket. The dampener body absorbs vibration from the plurality of strings. An accelerometer is coupled within the dampener body. A vibration sensor is within the dampener body to detect when a ball is struck. A microcontroller is coupled within the dampener body and is in operational communication with the accelerometer. A memory chip is coupled within the dampener body and is in operational communication with the microcontroller. A transceiver is coupled within the dampener body. The transceiver is in operational communication with the microcontroller and configured to wirelessly communicate with an app on a smartphone or computer. A battery is coupled within the dampener body. The battery is in operational communication with the accelerometer, the microcontroller, and the transceiver. A charge port is coupled to the dampener body. The charge port is in operational communication with the battery.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
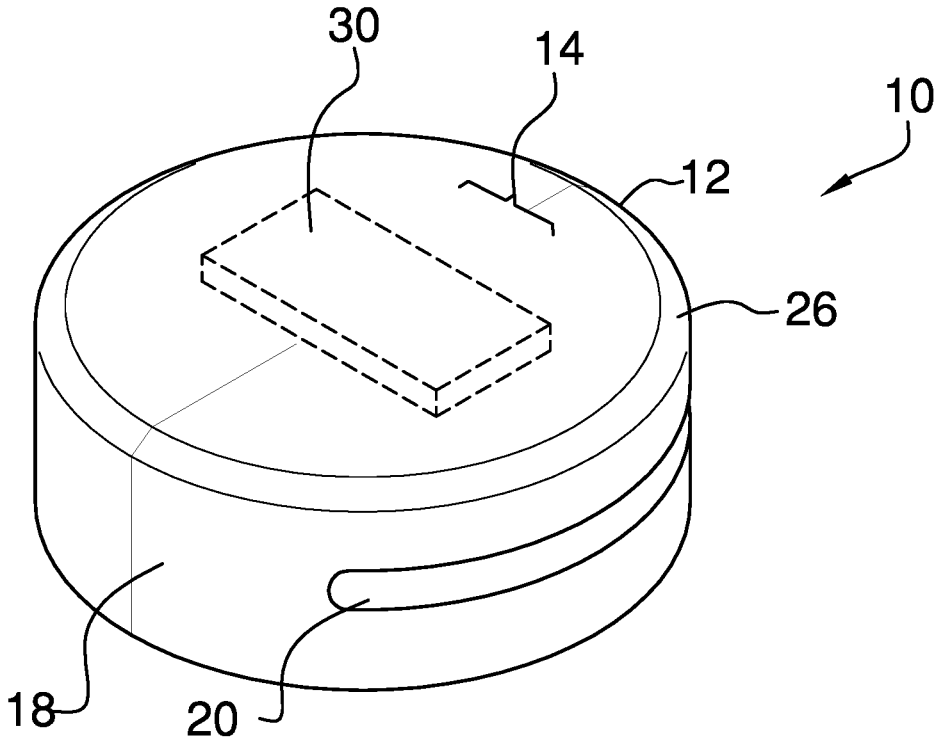
FIG. 1 is an isometric view of a racket dampener swing sensor apparatus according to an embodiment of the disclosure.
Figure 2:
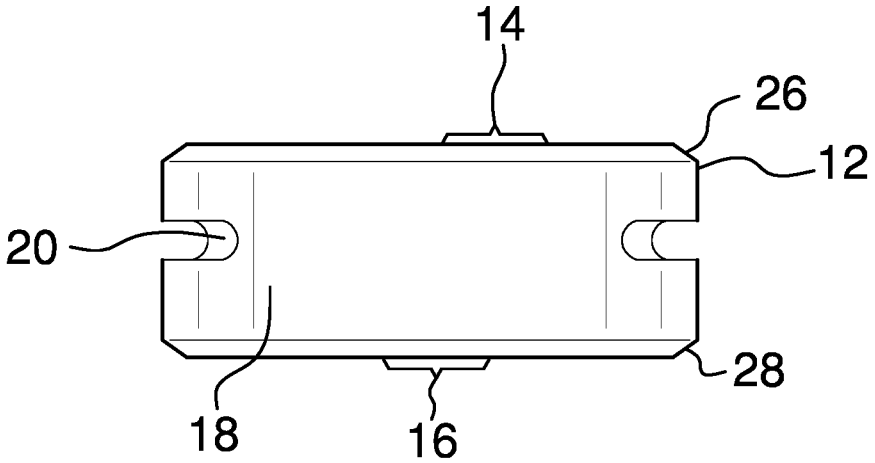
FIG. 2 is a bottom plan view of an embodiment of the disclosure.
Figure 3:
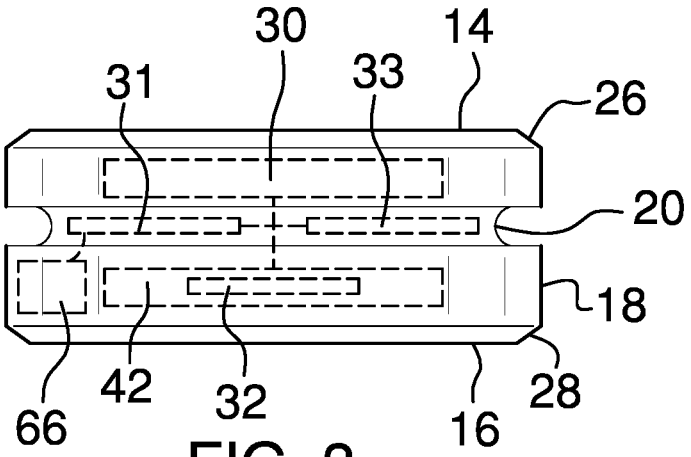
FIG. 3 is a top plan view of an embodiment of the disclosure.
Figure 4:
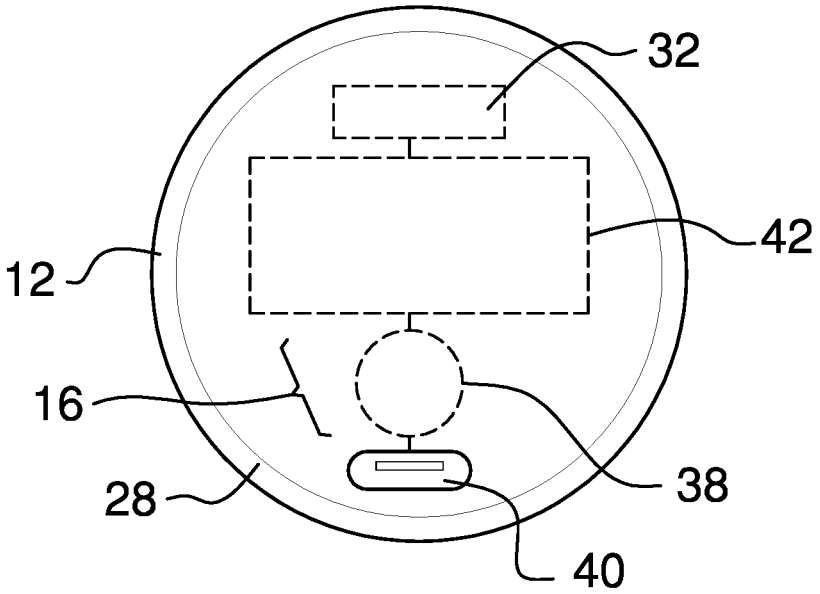
FIG. 4 is a rear elevation view of an embodiment of the disclosure.
Figure 5:
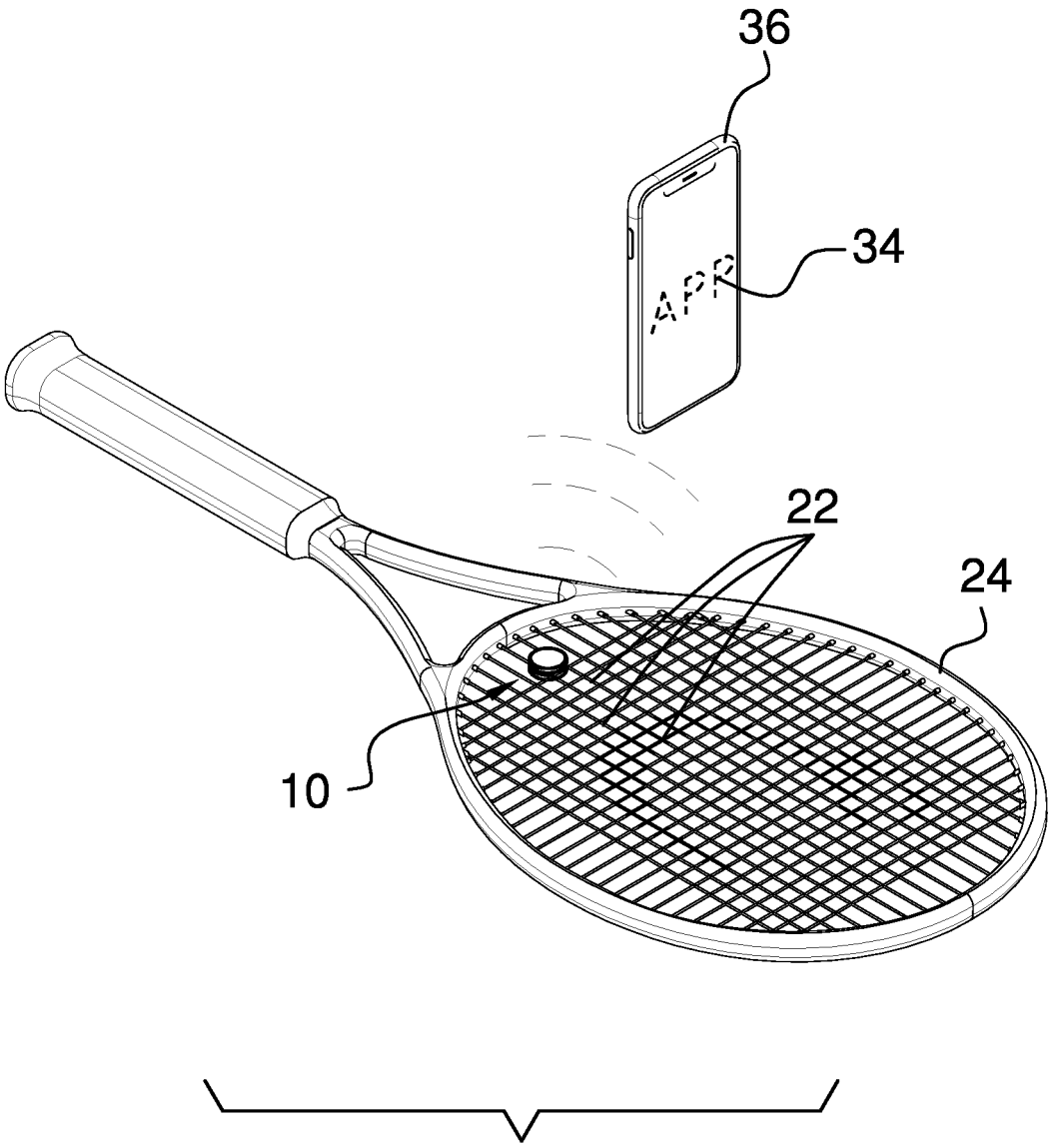
FIG. 5 is an in-use view of an embodiment of the disclosure.
Figure 6:
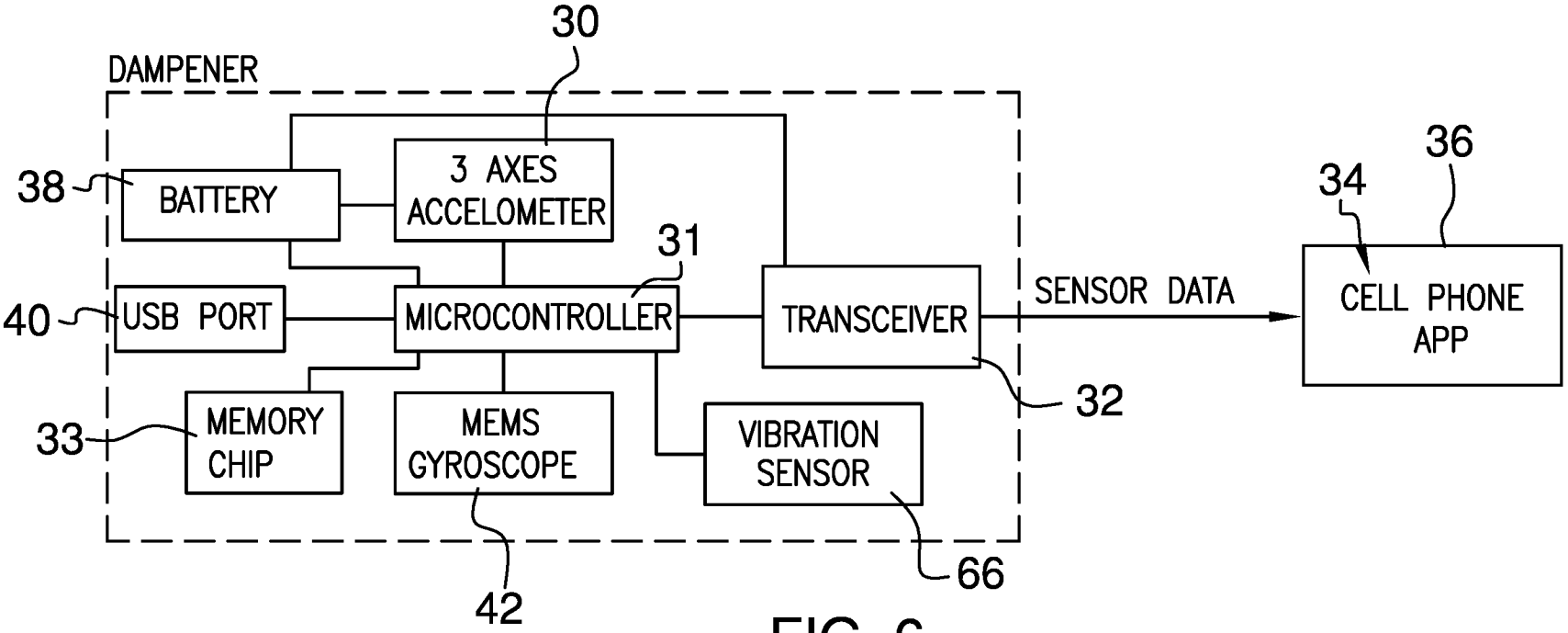
FIG. 6 is a block diagram view of an embodiment of the disclosure.
Figure 7:
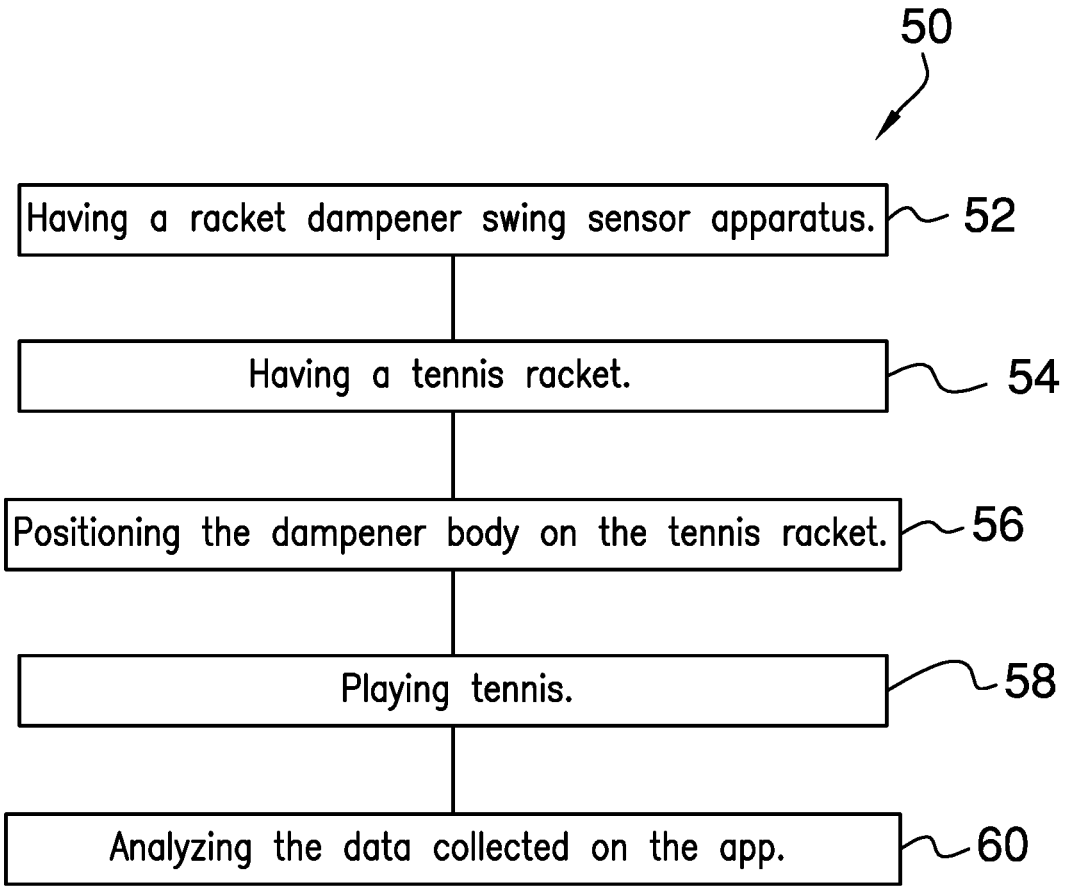
FIG. 7 is a block diagram view of an embodiment of the disclosure.

With reference now to the drawings, and in particular to FIGS. 1 through 7 thereof, a new racket dampener device embodying the principles and concepts of an embodiment of the disclosure and generally designated by the reference numeral 10 will be described.

As best illustrated in FIGS. 1 through 7, the racket dampener swing sensor apparatus 10 generally comprises a dampener body 12 having a body front side 14, a body back side 16, and a body perimeter 18. The body perimeter 18 has a string channel 20 configured to selectively engage a plurality of strings 22 of a tennis racket 24. The string channel 20 extends between 180° and 360° around the body perimeter 18. The string channel 20 may be medially positioned between the body front side 14 and the body back side 16.

A front perimeter 26 and a back perimeter 28 of the body front side and the body back side, respectively, may be chamfered. The body front side 14 and the body back side 16 may be circular. The dampener body 12 absorbs vibration from the plurality of strings 22.

An accelerometer 30 is coupled within the dampener body 12. The accelerometer 30 may be a three axis accelerometer 30. A microcontroller 31 is coupled within the dampener body 12 and is in operational communication with the accelerometer 30. A memory chip 33 is coupled within the dampener body 12 and is in operational communication with the microcontroller 31. The memory chip 33 may be flash storage.

A vibration sensor 66 is coupled within the dampener body 12. The vibration sensor 66 may be a piezoelectric sensor to detect vibration from striking a ball with the tennis racket 24. The vibration sensor 66 is operationally coupled to the microcontroller 31.

A transceiver 32 is coupled within the dampener body 12. The transceiver 32 is in operational communication with the microcontroller 31 and configured to wirelessly communicate with an app 34 on an extrinsic device 36 such as a smartphone, tablet, or computer. The transceiver 32 may be a wireless personal access network transmitter 32.

A battery 38 is coupled within the dampener body 12. The battery 38 is in operational communication with the accelerometer 30, the microcontroller 31, and the transceiver 32. A charge port 40 is coupled to the dampener body 12 and is in operational communication with the battery 38. The charge port 40 may extend through the body back side 16 and may receive universal serial bus charge cables.

A micro electrical mechanical system (MEMS) gyroscope 42 may be coupled within the dampener body 12 to measure rotational velocity of the tennis racket 24. The microcontroller 31 and the battery 38 are in operational communication with the MEMS gyroscope 42. The microcontroller 31 retrieves data from the accelerometer 30 and the MEMS gyroscope 42. The memory chip 33 stores the data collected from the accelerometer 30 and the MEMS gyroscope 42 via the microcontroller 31. The data from the MEMS gyroscope 42 identifies the shot type (forehand, backhand, serve, topspin, slice, or flat) and the data from the accelerometer 30 collects the hit velocity.

In use, the racket dampener swing sensor apparatus 10 allows for a method of use 50 comprising a step 52 comprising having the racket dampener swing sensor apparatus 10. A step 54 comprises having the tennis racket 24 with the tennis racket 24 having the plurality of strings 22. A step 56 comprises positioning the dampener body 12 on the tennis racket 24 with the string channel 20 receiving the plurality of strings 22. A step 58 comprises playing tennis with the tennis racket 24 while the transceiver 32 communicates with the smartphone or computer 36. A step 60 comprises analyzing the data generated from the app 34 on the smartphone or computer to compare hit velocity for each shot type (forehand, backhand, serve, topspin, slice, or flat).

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A racket dampener swing sensor apparatus comprising:

a dampener body having a body front side, a body back side, and a body perimeter, the body perimeter having a string channel configured to selectively engage a plurality of strings of a tennis racket, the dampener body absorbing vibration from the plurality of strings, the string channel extending at least 180° around the body perimeter and less than 360° around the body perimeter, a front perimeter and a back perimeter of the body front side and the body back side, respectively, being chamfered;

an accelerometer coupled within the dampener body;

a vibration sensor coupled within the dampener body;

a microcontroller coupled within the dampener body, the microcontroller being in operational communication with the accelerometer and the vibration sensor;

a memory chip coupled within the dampener body, the memory chip being in operational communication with the microcontroller;

a transceiver coupled within the dampener body, the transceiver being in operational communication with the accelerometer and the microcontroller and configured to wirelessly communicate with an app on an extrinsic device;

a battery coupled within the dampener body, the battery being in operational communication with the accelerometer, the microcontroller and the transceiver; and a charge port coupled to the dampener body, the charge port being in operational communication with the battery.

2. The racket dampener swing sensor apparatus of claim 1 further comprising the accelerometer being a three axis accelerometer.

3. The racket dampener swing sensor apparatus of claim 1 further comprising a micro electrical mechanical system (MEMS) gyroscope coupled within the dampener body, the microcontroller and the battery being in operational communication with the MEMS gyroscope.

4. The racket dampener swing sensor apparatus of claim 1 further comprising the body front side and the body back side being circular.

5. The racket dampener swing sensor apparatus of claim 1 further comprising the vibration sensor being a piezoelectric sensor.

6. A racket dampener swing sensor apparatus comprising:

a dampener body having a body front side, a body back side, and a body perimeter, the body perimeter having a string channel configured to selectively engage a plurality of strings of a tennis racket, the string channel extending between 180° and 360° around the body perimeter, a front perimeter and a back perimeter of the body front side and the body back side, respectively, being chamfered, the body front side and the body back side being circular, the dampener body absorbing vibration from the plurality of strings;

an accelerometer coupled within the dampener body, the accelerometer being a three axis accelerometer;

a vibration sensor coupled within the dampener body, the vibration sensor being a piezoelectric sensor;

a microcontroller coupled within the dampener body, the microcontroller being in operational communication with the accelerometer;

a memory chip coupled within the dampener body, the memory chip being in operational communication with the microcontroller;

a transceiver coupled within the dampener body, the transceiver being in operational communication with the microcontroller and configured to wirelessly communicate with an app on an extrinsic device;

a battery coupled within the dampener body, the battery being in operational communication with the accelerometer, the microcontroller, and the transceiver;

a micro electrical mechanical system (MEMS) gyroscope coupled within the dampener body, the microcontroller and the battery being in operational communication with the MEMS gyroscope; and a charge port coupled to the dampener body, the charge port being in operational communication with the battery.

7. A method of dampening tennis racket strings and choosing a tennis racket comprising:

having a racket dampener swing sensor apparatus comprising:

a dampener body having a body front side, a body back side, and a body perimeter, the body perimeter having a string channel configured to selectively engage a plurality of strings of a tennis racket, the string channel extending between 180° and 360° around the body perimeter, a front perimeter and a back perimeter of the body front side and the body back side, respectively, being chamfered, the body front side and the body back side being circular, the dampener body absorbing vibration from the plurality of strings;

an accelerometer coupled within the dampener body, the accelerometer being a three axis accelerometer;

a vibration sensor coupled within the dampener body, the vibration sensor being a piezoelectric sensor;

a microcontroller coupled within the dampener body, the microcontroller being in operational communication with the accelerometer;

a memory chip coupled within the dampener body, the memory chip being in operational communication with the microcontroller;

a transceiver coupled within the dampener body, the transceiver being in operational communication with the microcontroller and configured to wirelessly communicate with an app on an extrinsic device;

a battery coupled within the dampener body, the battery being in operational communication with the accelerometer, the microcontroller, and the transceiver;

a micro electrical mechanical system (MEMS) gyroscope coupled within the dampener body, the microcontroller, and the battery being in operational communication with the MEMS gyroscope; and a charge port coupled to the dampener body, the charge port being in operational communication with the battery;

having a tennis racket, the tennis racket having a plurality of strings;

positioning the dampener body on the tennis racket with the string channel receiving the plurality of strings;

playing tennis with the tennis racket while the transceiver communicates with the extrinsic device; and analyzing the data generated from the app on a smartphone or computer to compare hit velocity for each shot type.

* * * * *